US010885831B2

(12) United States Patent
Yang et al.

(10) Patent No.: US 10,885,831 B2
(45) Date of Patent: Jan. 5, 2021

(54) DISPLAY METHOD AND DISPLAY SYSTEM OF SINGULAR-SHAPED DISPLAY PANEL, STORAGE DEVICE AND DISPLAY DEVICE

(71) Applicants: Beijing BOE Optoelectronics Technology Co., Ltd., Beijing (CN); BOE Technology Group Co., Ltd., Beijing (CN)

(72) Inventors: Yi Yang, Beijing (CN); Wei Li, Beijing (CN); Jiaxing Chen, Beijing (CN); Huaxu Yang, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/555,746

(22) Filed: Aug. 29, 2019

(65) Prior Publication Data

US 2020/0074918 A1 Mar. 5, 2020

(30) Foreign Application Priority Data

Aug. 30, 2018 (CN) ..... 2018 1 1002194

(51) Int. Cl.
*G09G 3/22* (2006.01)
*G09G 3/20* (2006.01)

(52) U.S. Cl.
CPC ..... *G09G 3/22* (2013.01); *G09G 3/2007* (2013.01); *G09G 2300/0439* (2013.01); *G09G 2310/0232* (2013.01); *G09G 2320/0242* (2013.01); *G09G 2320/0646* (2013.01); *G09G 2360/16* (2013.01)

(58) Field of Classification Search
CPC combination set(s) only.
See application file for complete search history.

(56) References Cited

U.S. PATENT DOCUMENTS

2013/0135299 A1* 5/2013 Park ..... G02B 30/27 345/419
2014/0043350 A1* 2/2014 Ikeda ..... G01J 1/02 345/589
2015/0139392 A1* 5/2015 Maack ..... A61B 6/4233 378/62
2019/0311672 A1* 10/2019 Jeong ..... G09G 3/34

* cited by examiner

*Primary Examiner* — Van N Chow
(74) *Attorney, Agent, or Firm* — Nath, Goldberg & Meyer; Joshua B. Goldberg

(57) ABSTRACT

The present application discloses a display method and a display system of a singular-shaped display panel, a storage device and a display device, the display method includes: selecting all sub-pixels in an integer number of edge pixels to form a set of sub-pixels to be adjusted, each sub-pixel in the set as a sub-pixel to be adjusted; acquiring an original brightness of a light-transmissive region of each sub-pixel to be adjusted in the set; calculating an ideal target brightness of an actual light-emitting region of each sub-pixel to be adjusted; determining a final target brightness of the actual light-emitting region of each sub-pixel to be adjusted according to the ideal target brightness of the actual light-emitting region of each sub-pixel to be adjusted; controlling each sub-pixels to be adjusted to display according to the final target brightness of the actual light-emitting region of each sub-pixel to be adjusted.

19 Claims, 5 Drawing Sheets

DISPLAY METHOD AND DISPLAY SYSTEM OF SINGULAR-SHAPED DISPLAY PANEL, STORAGE DEVICE AND DISPLAY DEVICE

CROSS-REFERENCE TO RELATED APPLICATIONS

The present application claims priority to Chinese Patent Application No. 201811002194.3, entitled "display method and display system of edge pixels, storage device and display device", filed on Aug. 30, 2018. the entire disclosure thereof is hereby incorporated by reference.

TECHNICAL FIELD

The present disclosure relates to the field of display technology, and in particular, to a display method and a display system of a singular-shaped display panel, a storage device and a display device.

BACKGROUND

In order to meet the individual needs of users, products with display panels having singular-shaped display areas have emerged, for example, a smart watch with a circular display area and a mobile phone with a "Bang screen", the manufacturer manufactures the display area in the display panel as a special shape (also referred to as " singular shape") that is not rectangular.

SUMMARY

Embodiments of the present disclosure provide a display method of a singular-shaped display panel, the singular-shaped display panel includes multiple edge pixels each of which includes a plurality of sub-pixels, each of the sub-pixels includes a light-transmissive region and an non-light-transmissive region, wherein a portion of the light-transmissive region of at least one of the sub-pixels of each edge pixel is blocked by a light-blocking pattern, and another portion of the light-transmissive region of the at least one of the sub-pixels of each edge pixel not being blocked is an actual light-emitting region, the display method of the singular-shaped display panel includes steps of:

selecting all of the sub-pixels in at least one edge pixel to form a set of sub-pixels to be adjusted, and each sub-pixel in the set of sub-pixels to be adjusted is regarded as one sub-pixel to be adjusted;

acquiring an original brightness of the light-transmissive region of each of the sub-pixels to be adjusted in the set of sub-pixels to be adjusted;

calculating an ideal target brightness of the actual light-emitting region of each of the sub-pixels to be adjusted, the ideal target brightness of the actual light-emitting region of the sub-pixel to be adjusted is equal to a ratio of the original brightness of the light-transmissive region of the sub-pixel to be adjusted to a relative transmittance of the sub-pixel to be adjusted, wherein the relative transmittance of the sub-pixel to be adjusted is equal to a ratio of an area of the actual light-emitting region to an area of the light-transmissive region of the sub-pixel to be adjusted;

determining, according to the ideal target brightness of the actual light-emitting region of each of the sub-pixels to be adjusted, a final target brightness of the actual light-emitting region of each of the sub-pixels to be adjusted, wherein the final target brightness is less than or equal to a preset maximum exhibited brightness; and controlling each of the sub-pixels to be adjusted to display according to the final target brightness of the actual light-emitting region of each of the sub-pixels to be adjusted.

In some implementations, the step of determining, according to the ideal target brightness of the actual light-emitting region of each of the sub-pixels to be adjusted, a final target brightness of the actual light-emitting region of each of the sub-pixels to be adjusted includes:

judging whether there is an ideal target brightness greater than the preset maximum exhibited brightness;

determining, in response to that there is no ideal target brightness greater than the preset maximum exhibited brightness, the final target brightness of the actual light-emitting region of each of the sub-pixels to be adjusted to be equal to the ideal target brightness of the actual light-emitting region of the sub-pixel to be adjusted.

In some implementations, in response to that there is an ideal target brightness greater than the preset maximum exhibited brightness, determining the final target brightness of the actual light-emitting region of the sub-pixel to be adjusted whose ideal target brightness is greater than the preset maximum exhibited brightness to be equal to the preset maximum exhibited brightness, and determining the final target brightness of the actual light-emitting region of the sub-pixel to be adjusted whose ideal target brightness is less than or equal to the preset maximum exhibited brightness to be equal to the ideal target brightness of the actual light-emitting region of the sub-pixel to be adjusted.

In some implementations, in response to that there is an ideal target brightness greater than the preset maximum exhibited brightness, the display method includes:

selecting the sub-pixel to be adjusted, whose actual light-emitting region has the largest ideal target brightness, as a reference sub-pixel;

determining the final target brightness of the actual light-emitting region of the reference sub-pixel to be equal to the preset maximum exhibited brightness;

calculating a brightness adjustment ratio, the brightness adjustment ratio being equal to a ratio of the final target brightness of the actual light-emitting region of the reference sub-pixel to the ideal target brightness of the actual light-emitting region of the reference sub-pixel;

calculating the final target brightness of the actual light-emitting region of each of the sub-pixels to be adjusted, and the final target brightness of the actual light-emitting region of the sub-pixel to be adjusted is equal to a product of the ideal target brightness of the actual light-emitting region of the sub-pixel to be adjusted and the brightness adjustment ratio.

In some implementations, the step of controlling each of the sub-pixels to be adjusted to display according to the final target brightness of the actual light-emitting region of each of the sub-pixels to be adjusted includes steps of:

determining grayscale voltages corresponding to the final target brightnesses of the sub-pixels to be adjusted;

supplying the corresponding grayscale voltages to the sub-pixels to be adjusted respectively.

In some implementations, the step of determining the grayscale voltages corresponding to the final target brightnesses of the sub-pixels to be adjusted includes a step of:

determining the grayscale voltages corresponding to the final target brightnesses of the sub-pixels to be adjusted according to a grayscale-brightness correspondence table.

In some implementations, the step of selecting all of the sub-pixels in at least one edge pixel to form a set of sub-pixels to be adjusted includes a step of:

selecting all of the sub-pixels in one of the edge pixels to form the set of sub-pixels to be adjusted.

In some implementations, the step of selecting all of the sub-pixels in at least one edge pixel to form a set of sub-pixels to be adjusted includes a step of:

selecting all of the sub-pixels in multiple adjacent edge pixels to form the set of sub-pixels to be adjusted.

In some implementations, the step of selecting all of the sub-pixels in at least one edge pixel to form a set of sub-pixels to be adjusted includes a step of:

selecting all of the sub-pixels in all edge pixels on the display panel to form the set of sub-pixels to be adjusted.

Embodiments of the present disclosure provide a display system of a singular-shaped display panel, the singular-shaped display panel includes multiple edge pixels each of which includes a plurality of sub-pixels, each of the sub-pixels includes a light-transmissive region and an non-light-transmissive region, wherein a portion of the light-transmissive region of at least one of the sub-pixels of each edge pixel is blocked by a light-blocking pattern, and another portion of the light-transmissive region of the at least one of the sub-pixels of each edge pixel not being blocked is an actual light-emitting region, the display system includes:

a selecting circuit, configured to select all of the sub-pixels in at least one edge pixel to form a set of sub-pixels to be adjusted, and each of the sub-pixels in the set of sub-pixels to be adjusted is regarded as one sub-pixel to be adjusted;

an acquiring circuit, configured to acquire an original brightness of the light-transmissive region of each of the sub-pixels to be adjusted in the set of sub-pixels to be adjusted;

a calculating circuit, configured to calculate an ideal target brightness of the actual light-emitting region of each of the sub-pixels to be adjusted, the ideal target brightness of the actual light-emitting region of the sub-pixel to be adjusted is equal to a ratio of the original brightness of the light-transmissive region of the sub-pixel to be adjusted to a relative transmittance of the sub-pixel to be adjusted, wherein the relative transmittance of the sub-pixel to be adjusted is equal to a ratio of an area of the actual light-emitting region of the sub-pixel to be adjusted to an area of the light-transmissive region of the sub-pixel to be adjusted;

a determining circuit, configured to determine, according to the ideal target brightness of the actual light-emitting region of each of the sub-pixels to be adjusted, a final target brightness of the actual light-emitting region of each of the sub-pixels to be adjusted, wherein the final target brightness is less than or equal to a preset maximum exhibited brightness; and a control circuit, configured to control each of the sub-pixels to be adjusted to display according to the final target brightness of the actual light-emitting region of each of the sub-pixels to be adjusted.

In some implementations, the determining circuit includes:

a judging sub-circuit, configured to judge whether there is an ideal target brightness greater than the preset maximum exhibited brightness;

a first judging sub-circuit, configured to determine, in response to that there is no ideal target brightness greater than the preset maximum exhibited brightness, the final target brightness of the actual light-emitting region of each of the sub-pixels to be adjusted to be equal to the ideal target brightness of the actual light-emitting region of the sub-pixel to be adjusted.

In some implementations, the determining circuit further includes:

a second judging sub-circuit, configured to determine, in response to that there is an ideal target brightness greater than the preset maximum exhibited brightness, the final target brightness of the actual light-emitting region of the sub-pixel to be adjusted whose ideal target brightness is greater than the preset maximum exhibited brightness to be equal to the preset maximum exhibited brightness, and the final target brightness of the actual light-emitting region of the sub-pixel to be adjusted whose ideal target brightness is less than or equal to the preset maximum exhibited brightness to be equal to the ideal target brightness of the actual light-emitting region of the sub-pixel to be adjusted.

In some implementations, the determining circuit further includes:

a selecting sub-circuit, configured to select, in response to that there is an ideal target brightness greater than the preset maximum exhibited brightness, the sub-pixel to be adjusted, whose actual light-emitting region has with the largest ideal target brightness, as a reference sub-pixel;

a third judging sub-circuit, configured to determine the final target brightness of the actual light-emitting region of the reference sub-pixel to be equal to the preset maximum exhibited brightness;

a first calculating sub-circuit, configured to calculate a brightness adjustment ratio, the brightness adjustment ratio being equal to a ratio of the final target brightness of the actual light-emitting region of the reference sub-pixel to the ideal target brightness of the actual light-emitting region of the reference sub-pixel;

a second calculating sub-circuit, configured to calculate the final target brightness of the actual light-emitting region of each of the sub-pixels to be adjusted, and the final target brightness of the actual light-emitting region of the sub-pixel to be adjusted is equal to a product of the ideal target brightness of the actual light-emitting region of the sub-pixel to be adjusted and the brightness adjustment ratio.

In some implementations, the control circuit includes:

a grayscale voltage judging sub-circuit, configured to determine grayscale voltages respectively corresponding to the final target brightnesses of the sub-pixels to be adjusted;

a driving sub-circuit, configured to supply the corresponding grayscale voltages to the sub-pixels to be adjusted respectively, wherein the grayscale voltage judging sub-circuit determines the grayscale voltages corresponding to the final target brightnesses of the sub-pixels to be adjusted according to a grayscale-brightness correspondence table.

In some implementations, the selecting circuit is configured to select all of the sub-pixels in one of the edge pixels to form the set of sub-pixels to be adjusted.

In some implementations, the selecting circuit is configured to select all of the sub-pixels in multiple adjacent edge pixels to form the set of sub-pixels to be adjusted.

In some implementations, the selecting circuit is configured to select all of the sub-pixels in all edge pixels on the display panel to form the set of sub-pixels to be adjusted.

Embodiments of the present disclosure provide a storage device, wherein a program is stored in the storage device, and the display method of the singular-shaped display panel described above is performed when the program is executed.

Embodiments of he present disclosure provide a display device including the above display system of the singular-shaped display panel.

DETAILED DESCRIPTION

In order to enable those skilled in the art to better understand the technical solutions of the present disclosure, a display method and a display system of a singular-shaped display panel, a storage device and a display device provided by the present disclosure are described in detail below with reference to the accompanying drawings.

In the related art, in the display panel whose display area is of singular-shaped shape, light-emitting boundary of edge pixels and boundary line of singular-shaped edge are matched as much as possible at the singular-shaped edged of the display area by blocking a portion of the edge pixel in a non-display area at the singular-shaped edge. However, since the portion of the edge pixel is blocked, a problem of color shift is apt to occur when the edge pixel normally displays.

An edge pixel includes a plurality of sub-pixels, each of the sub-pixels includes a light-transmissive region and an non-light-transmissive region, wherein the light-transmissive region (also referred to as a display region) is a region for performing light-emitting display, and the non-light-transmissive region (also referred to as a non-display region) is provided with a pixel circuit (including a thin film transistor) therein. Blocking the edge pixels by using the blocking pattern in the related art specifically refers to blocking a portion of the light-transmissive region of at least one sub-pixel in the edge pixel.

In a case where the edge pixel located at the singular-shaped edge is blocked, it is bound to lead to a reduced actual light-emitting region of at least one sub-pixel within the edge pixel. For the sub-pixel with the reduced actual light-emitting region, if the actual light-emitting region of the sub-pixel still displays the original brightness, the overall light-emitting region of the sub-pixel exhibits an equivalent brightness that is smaller than the original brightness. The overall display brightness of the sub-pixel perceived by the user is significantly reduced.

In addition, in a case where blocked areas of two or more sub-pixels in a same edge pixel are different, reductions of the equivalent brightnesses of the blocked sub-pixels in the edge pixel are different compared to the original brightness of the light-transmissive region. In such case, the edge pixel will have a color shift problem.

Figure 1:
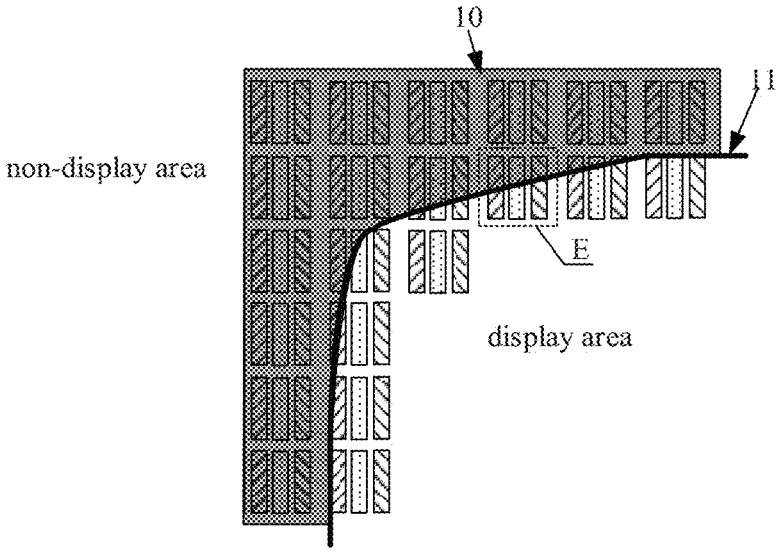
FIG. 1 is a schematic view of a singular-shaped boundary of a display panel.
Figure 2:
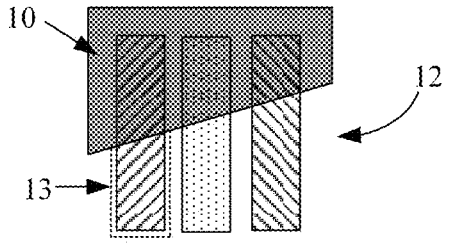
FIG. 2 is an enlarged schematic view of the region E in FIG. 1.

FIG. 1 is a schematic view of a singular-shaped boundary of a display panel, and FIG. 2 is an enlarged schematic view of a region E of FIG. 1. As shown in FIG. 1 and FIG. 2, a boundary between a display area and a non-display area on the display panel defines a boundary line. A portion of the boundary line at a corner (also referred to as "R corner") is of non-right angle, which forms a singular-shaped boundary.

In such case, there are some edge pixels 12 at the edge of the display area corresponding to the singular-shaped boundary, a portion of each of the edge pixels 12 is located inside the singular-shaped boundary 11 (that is, in the display area), and the other portion of each of the edge pixels 12 is located outside the singular-shaped boundary 11 (that is, in the non-display area). In order to cause the light-emitting boundary of the edge pixel 12 to match with the singular-shaped boundary as much as possible, a light-blocking pattern 10 is always used to block a portion of the edge pixel 12 located outside the singular-shaped boundary 11, and in such case, at least one sub-pixel, a portion of which is blocked by the light-blocking pattern 10, exists in the edge pixel 12. For each of the sub-pixels that are partially blocked by the light-blocking pattern 10, an area of the actual light-emitting region 13 thereof is reduced, and in a case where the actual light-emitting region 13 maintains the original brightness, the overall equivalent brightness of the light-transmissive region of the sub-pixel is lowered.

It should be noted that, in practical applications, to ensure that the edge pixels 12 located at the singular-shaped boundary 11 can still display full color independently, there is no possibility that the light-blocking pattern 10 completely blocks one or more sub-pixels of the edge pixel 12.

In the present disclosure, the term "actual light-emitting region 13" of the sub-pixel specifically refers to a region of the sub-pixel that is not blocked by the light-blocking pattern 10; the term "area of the light-transmissive region" of the sub-pixel specifically refers to a sum of the area of the actual light-emitting region of the sub-pixel and an area of the portion of the light-transmitting region blocked by the light-blocking pattern 10.

In addition, the term "brightness of the actual light-emitting region 13" in the present disclosure specifically refers to brightness of light emitted from the actual light-emitting region 13, and the term "the overall equivalent brightness of the light-transmitting region of the sub-pixel" specifically refers to an equivalent brightness exhibited by both of the actual light-emitting region 13 of the sub-pixel and the portion of the light-transmissive region blocked by the light-blocking pattern 10, the "equivalent brightness" being equal to a product of the brightness of the actual light-emitting region 13 and a relative transmittance of the sub-pixel, wherein the "relative transmittance" of the sub-pixel is equal to a ratio of the area of the actual light-emitting region 13 of the sub-pixel to the area of the light-transmissive region of the sub-pixel.

The term "edge pixel 12" in the present disclosure specifically refers to a pixel located at the R corner, the edge pixel 12 includes a plurality of sub-pixels, and a portion of at least one sub-pixel of the edge pixel 12 is blocked by the light-blocking pattern 10. Certainly, there may also be a sub-pixel in the edge pixel 12, which is not blocked by the light-blocking pattern 10.

Figure 3:
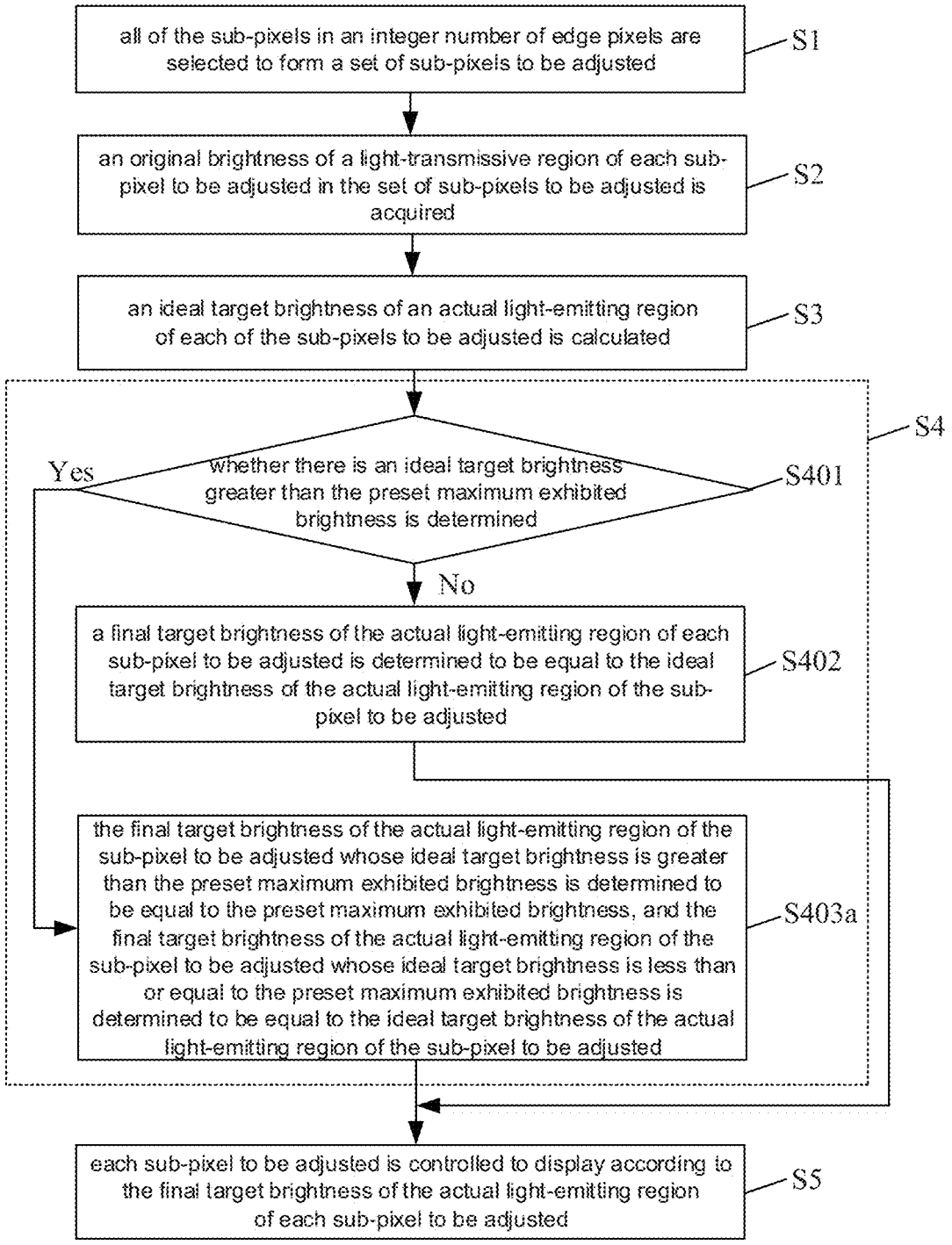
FIG. 3 is a flowchart of a display method of a singular-shaped display panel according to an embodiment of the present disclosure.

FIG. 3 is a flowchart of a display method of a singular-shaped display panel according to an embodiment of the present disclosure. As shown in FIG. 3, the display method of the singular-shaped display panel includes steps S1 to S5.

At step S1, all of the sub-pixels in an integer number of edge pixels are selected to form a set of sub-pixels to be adjusted, and each sub-pixel in the set of sub-pixels to be adjusted is regarded as one sub-pixel to be adjusted.

In the step S1 one, two or more edge pixels may be selected. In the set of sub-pixels to be adjusted, at least one sub-pixel to be adjusted is partially blocked by the light-blocking pattern. Certainly, the set of sub-pixels to be adjusted may also include a sub-pixel to be adjusted, which is not blocked by the light-blocking pattern.

In this embodiment, it is assumed that the number of the sub-pixels to be adjusted in the set of sub-pixels to be adjusted is N.

At the step S2, an original brightness of a light-transmissive region of each sub-pixel to be adjusted in the set of sub-pixels to be adjusted is acquired.

In the step S2, the original brightness of the light-transmissive region of each sub-pixel to be adjusted may be determined based on a video data stream in RGB channel.

At the step S3, an ideal target brightness of an actual light-emitting region of each of the sub-pixels to be adjusted is calculated.

In the step S3, the ideal target brightness of the actual light-emitting region of the sub-pixel to be adjusted is equal to a ratio of the original brightness of the light-transmissive region of the sub-pixel to be adjusted to a relative transmittance of the sub-pixel to be adjusted.

$$B_i = \frac{A_i}{P_i}$$

Where, $B_i$ represents the ideal target brightness of the actual light-emitting region of the i-th sub-pixel to be adjusted, $A_i$ represents the original brightness of the actual light-emitting region of the i-th sub-pixel to be adjusted, and $P_i$ represents the relative transmittance of the i-th sub-pixel to be adjusted.

The relative transmittance of the sub-pixel to be adjusted may be measured in advance. The relative transmittance of the sub-pixel to be adjusted is equal to a ratio of an area of the actual light-emitting region of the sub-pixel to be adjusted to an area of the light-transmissive region of the sub-pixel to be adjusted.

$$P_i = \frac{M_i}{M_{pixel_i}};$$

Where, $M_i$ represents the area of the actual light-emitting region of the i-th sub-pixel to be adjusted, $M_{pixel_i}$ represents the area of the light-transmissive region of the i-th sub-pixel to be adjusted, and $1 \leq i \leq N$ and i is an integer.

It should be noted that the case where the light-transmissive regions of the sub-pixels in FIG. 2 are the same is only illustrative, which does not limit the technical solution of the present disclosure. In the present disclosure, the areas of the light-transmissive regions of the sub-pixels to be adjusted may be the same or different, which is not limited in the present disclosure.

It should be noted that the "original brightness" in the present disclosure means a brightness, which is expected to be exhibited by the overall light-transmissive region of the sub-pixel to be adjusted, in a case where the light-transmissive region of the sub-pixel to be adjusted is not blocked by the light-blocking pattern, the brightness can be controlled by a grayscale voltage input to the sub-pixel to be adjusted. However, since the light-transmissive region of the sub-pixel to be adjusted is partially blocked, when an original grayscale voltage is supplied to the sub-pixel to be adjusted so that the actual light-emitting region of the sub-pixel exhibits the original brightness, the light-transmissive region of the sub-pixel to be adjusted presents an overall equivalent brightness, which is $A_i*P_i$ and less than the original brightness. In order to make the overall equivalent brightness of the light-transmissive region of the sub-pixel to be $A_i$, the brightness of the actual light-emitting region needs to be adjusted to be $$\frac{A_i}{P_i}.$$

In such case, reduction of brightness of the sub-pixel and the color shift of the edge pixels can be effectively solved.

However, in practical applications, the number of different brightnesses that each sub-pixel on the display panel can exhibit is limited. For example, if the display bit number is 8, the sub-pixel can exhibit $2^8=256$ different brightnesses, which correspond to grayscales L0-L255. When the grayscale voltage corresponds to L255, the sub-pixel has a preset maximum exhibited brightness (i.e., the preset maximum brightness that can be exhibited by the light-transmissive region of each sub-pixel in the display panel). In this case, when the ideal target brightness calculated in step S3 is greater than the preset maximum exhibited brightness, obviously, the sub-pixel to be adjusted cannot be directly compensated with the ideal target brightness. Therefore, the ideal target brightness calculated in step S3 needs to be further processed.

At the step S4, a final target brightness of the actual light-emitting region of each sub-pixel to be adjusted, that is, a final actual light-emitting brightness of the actual light-emitting region of the sub-pixel to be adjusted, is determined according to the ideal target brightness of the actual light-emitting region of each sub-pixel to be adjusted, wherein the final target brightness is less than or equal to the preset maximum exhibited brightness.

In some embodiments, the step S4 includes steps S401 to S403*a*.

At the step S401, whether there is an ideal target brightness greater than the preset maximum exhibited brightness is determined.

If it is determined that there is no ideal target brightness greater than the preset maximum exhibited brightness, the following step S402 is performed, otherwise, the following step S403*a* is performed.

At the step S402, a final target brightness of the actual light-emitting region of each sub-pixel to be adjusted is determined to be equal to the ideal target brightness of the actual light-emitting region of the sub-pixel to be adjusted.

If it is determined that the ideal target brightness of the actual light-emitting region of each of the sub-pixels to be adjusted calculated in step S3 is less than or equal to the preset maximum exhibited brightness, the ideal target brightness may be directly determined as the final target brightness in step S402 to compensate the sub-pixels to be adjusted (the brightness of the actual light-emitting region of the sub-pixel to be adjusted is equal to the ideal target brightness), and the overall equivalent brightness of the light-transmissive region of each sub-pixel to be adjusted is equal to its original brightness.

It should be noted that when the final target brightness of the actual light-emitting region of each sub-pixel to be adjusted is equal to the corresponding ideal target brightness, the overall equivalent brightness of the light-transmissive region of each sub-pixel to be adjusted is equal to the original brightness of the light-transmissive region of each sub-pixel to be adjusted. Thus, the brightnesses of the sub-pixels to be adjusted can be compensated while avoiding the problem of color shift of the edge pixels, and the original display effect can be maintained to the greatest extent.

At step S403*a*, the final target brightness of the actual light-emitting region of the sub-pixel to be adjusted whose ideal target brightness is greater than the preset maximum exhibited brightness is determined to be equal to the preset maximum exhibited brightness, and the final target brightness of the actual light-emitting region of the sub-pixel to be adjusted whose ideal target brightness is less than or equal to the preset maximum exhibited brightness is determined to be equal to the ideal target brightness of the actual light-emitting region of the sub-pixel to be adjusted.

If it is determined that there is at least one of the ideal target brightnesses of the actual light-emitting regions of the sub-pixels to be adjusted calculated in step S3 greater than the preset maximum exhibited brightness, in step S403*a*, the final target brightness of the actual light-emitting region of the sub-pixel to be adjusted whose ideal target brightness is greater than the preset maximum exhibited brightness is determined to be equal to the preset maximum exhibited brightness, and the final target brightness of the sub-pixel to be adjusted whose ideal target brightness is less than or equal to the preset maximum brightness is determined to be equal to the ideal target brightness of the actual light emitting region of the sub-pixel to be adjusted.

It should be noted that although the technical means of the above step S403*a* cannot completely eliminate the color shift, the color shift problem can be mitigated to some extent (the color shift is weaken). In particular, when the sub-pixels in the set of sub-pixels to be adjusted are from a plurality of edge pixels, it can be found through actual application observation that the overall color shift exhibited by the plurality of edge pixels is significantly improved.

At the step S5, each sub-pixel to be adjusted is controlled to display according to the final target brightness of the actual light-emitting region of each sub-pixel to be adjusted.

The step S5 includes a step S501, in which grayscale voltages corresponding to the final target brightnesses are determined.

In the step S501, the grayscale voltages corresponding to the final target brightnesses may be determined according to a grayscale-brightness correspondence table acquired in advance.

The grayscale-brightness correspondence table records different grayscale voltages and light-emitting brightnesses corresponding to the respective grayscale voltages. The light-emitting brightness corresponding to the grayscale voltage refers to the brightness of the light emitted by the light-transmitting region after the sub-pixel receives the grayscale voltage in a case where the light-transmissive region of the sub-pixel is not blocked by the light-blocking pattern, and the grayscale-brightness correspondence table can be obtained by experiments in advance. Table 1 is a grayscale-brightness correspondence table in the present disclosure.

TABLE 1

| grayscale | grayscale voltage | light-emitting brightness |
|---|---|---|
| L0 | V0 | Q0 |
| L1 | V1 | Q1 |
| L2 | V2 | Q2 |
| L3 | V3 | Q3 |

TABLE 1-continued

| grayscale | grayscale voltage | light-emitting brightness |
|---|---|---|
| L4 | V4 | Q4 |
| . . . | . . . | . . . |
| L255 | V255 | Q255 |

In this embodiment, the number of display bits of the sub-pixel is 8, and each sub-pixel can exhibit $2^8=256$ different brightnesses, which correspond to grayscales L0-L255, grayscale voltages V0-V255, and light-emitting brightnesses Q0 to A255, wherein the grayscale voltage Vj corresponds to the light emitting brightness Qj, and $0 \leq j \leq 255$ and j is an integer. The exhibitable light-emitting brightnesses of the sub-pixel are discretely distributed.

As an alternative, step S501 includes steps S5011 to S5013.

At the step S5011, it is detected whether or not a light-emitting brightness the same as the final target brightness is recorded in the grayscale-brightness correspondence table.

Since the light-emitting brightnesses Qj recorded in the grayscale brightness correspondence table are discretely distributed, the final target brightness calculated in the step S4 may be the light-emitting brightness recorded in the grayscale-brightness correspondence table, or may not be the light-emitting brightness recorded in the grayscale-brightness correspondence table.

If it is detected that the light-emitting brightness the same as the final target brightness is recorded in the grayscale-brightness correspondence table, a step S5012 is performed. If it is detected that the light-emitting brightness the same as the final target brightness is not recorded in the grayscale-brightness correspondence table, steps S5013*a*, S5013*b* or step S5013*c* may be performed.

At the step S5012, the grayscale voltage corresponding to the brightness the same as the final target brightness is found from the grayscale-brightness correspondence table as the grayscale voltage corresponding to the final target brightness.

At the step S5013*a*, from the grayscale-brightness correspondence table, a grayscale voltage corresponding to the light-emitting brightness that is smaller than the final target brightness and closest to the final target brightness is found as the grayscale voltage corresponding to the final target brightness.

At the step S5013*b*, from the grayscale-brightness correspondence table, a grayscale voltage corresponding to the light-emitting brightness that is greater than the final target brightness and closest to the final target brightness is found as the grayscale voltage corresponding to the final target brightness.

At the step S5013*c*, from the grayscale brightness correspondence table, a grayscale voltage corresponding to the light-emitting brightness that is closest to the final target brightness is found as the grayscale voltage corresponding to the final target brightness.

When the final target brightness is one of the light-emitting brightnesses recorded in the grayscale-brightness correspondence table, the grayscale voltage corresponding to the final target brightness is directly determined by looking up the table in step S5012; when the final target brightness is not one of the light-emitting brightnesses recorded in the grayscale-brightness correspondence table, the grayscale voltage corresponding to the final target brightness can be determined by selecting any one of the above-described steps S5013*a*, S5013*b*, and S5013*c* as needed.

It should be noted that the case where the grayscale voltages and the light-emitting brightnesses recorded in the grayscale-brightness correspondence table are in one-to-one correspondence is only an optional solution in the present disclosure. In the present disclosure, a grayscale voltage may also correspond to a light-emitting brightness range. In this case, the corresponding grayscale voltage may be determined by determining the light-emitting brightness range in which the final target brightness is located, and this case also falls within the protection scope of the present disclosure.

After the grayscale voltages corresponding to the final target brightnesses are determined through the step S501, a step S502 is performed.

At the step S502, the corresponding grayscale voltages are supplied to the sub-pixels to be adjusted.

By supplying the corresponding grayscale voltages to the sub-pixels to be adjusted, the actual light-emitting regions of the sub-pixels to be adjusted exhibit corresponding final target brightnesses (or brightnesses close to the final target brightnesses as much as possible), thereby improving or even completely eliminating color shifts.

Figure 4:
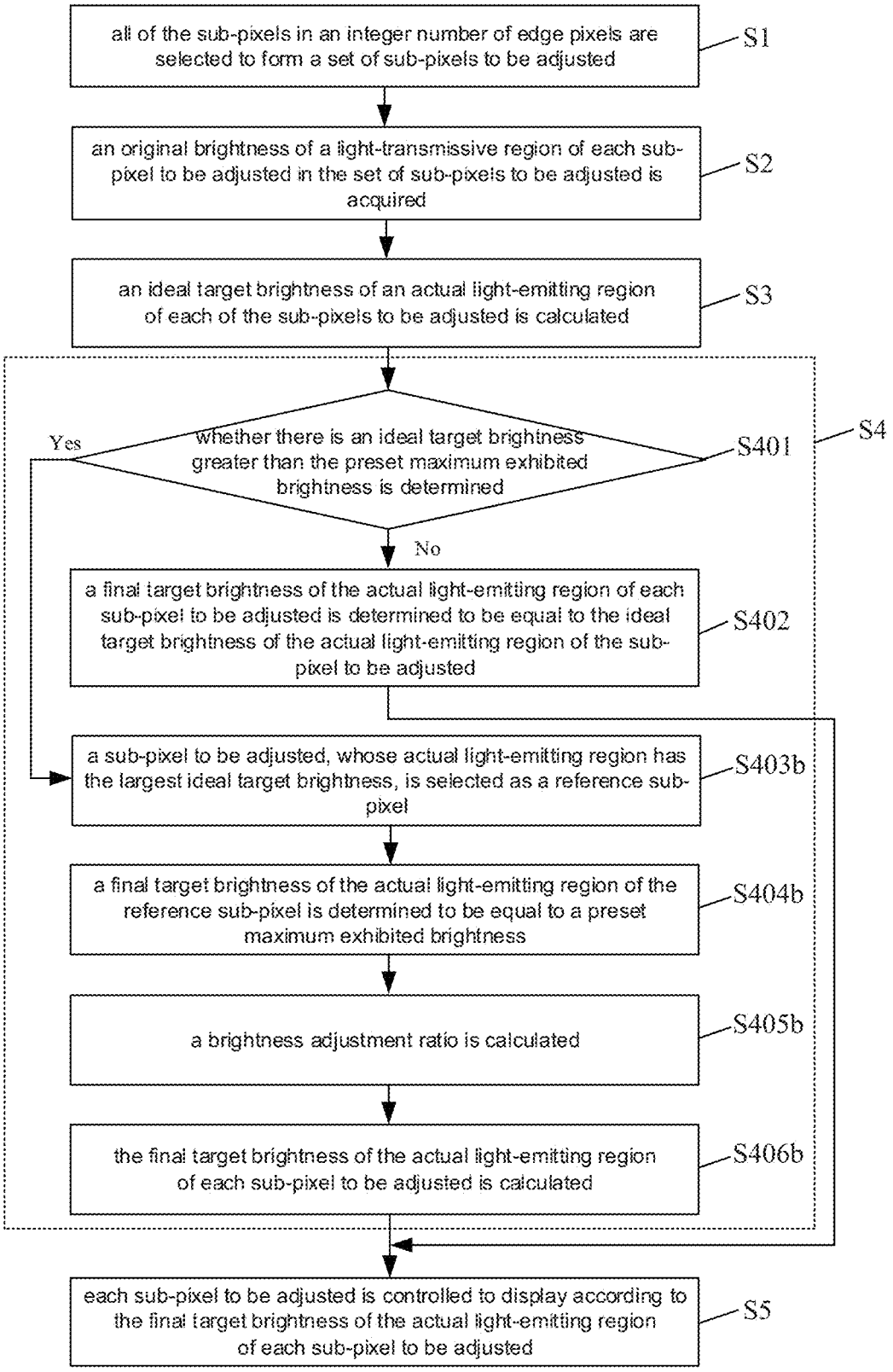
FIG. 4 is a structural block diagram of an edge pixel display system according to an embodiment of the present disclosure.

FIG. 4 is a flowchart of a display method of a singular-shaped display panel according to another embodiment of the present disclosure. As shown in FIG. 4, the difference between the display method of the singular-shaped display panel and the display method of the singular-shaped display panel shown in the above embodiment is in that, in this embodiment, when it is determined in step S401 that the ideal target brightness is greater than the preset maximum exhibited brightness, the following steps S403*b* to S406*b* are performed, and only steps S403*b* to S406*b* are described in detail below. Other steps can refer to the corresponding content in the foregoing embodiment, and details thereof are not described herein again.

At the step S403*b*, a sub-pixel to be adjusted, whose actual light-emitting region has the largest ideal target brightness, is selected as a reference sub-pixel.

At the step S404*b*, a final target brightness of the actual light-emitting region of the reference sub-pixel is determined to be equal to a preset maximum exhibited brightness.

At the step S405*b*, a brightness adjustment ratio is calculated.

The brightness adjustment ratio is equal to a ratio of the final target brightness of the actual light-emitting region of the reference sub-pixel to an ideal target brightness of the actual light-emitting region of the reference sub-pixel.

At the step S406*b*, the final target brightness of the actual light-emitting region of each sub-pixel to be adjusted is calculated.

The final target brightness of the actual light-emitting region of the sub-pixel to be adjusted is equal to a product of the ideal target brightness of the actual light-emitting region of the sub-pixel to be adjusted and the brightness adjustment ratio.

In this embodiment, when the ideal target brightness is greater than the preset maximum exhibited brightness, first, the sub-pixel to be adjusted, whose actual light-emitting region has the largest target brightness, is selected as the reference sub-pixel, and the preset maximum exhibited brightness is used as the final target brightness of the actual light-emitting region of the reference sub-pixel; then, the brightness adjustment ratio with which the brightness of the actual light-emitting region of the reference sub-pixel is adjusted from the ideal target brightness to the final target brightness is determined; finally, the ideal target brightness of the actual light-emitting region of each sub-pixel to be adjusted is adjusted proportionally according to the previously calculated brightness adjustment ratio to obtain the final target brightness of the actual light-emitting region of each sub-pixel to be adjusted.

Compared with the technical means shown in the step S403*a* in the embodiment shown in FIG. 3, in the present embodiment, the step S403*b* to step S406*b* are performed to adjust the ideal target brightnesses of the actual light-emitting regions of the sub-pixels to be adjusted in a same proportion, the color shift problem can be completely eliminated.

To facilitate a person skilled in the art to better understand the technical solutions of the present disclosure, the display method of the singular-shaped display panel provided by the present disclosure will be described in detail below with reference to several specific examples.

EXAMPLE 1

It is assumed that the set of sub-pixels to be adjusted selected in the step S1 is obtained from one edge pixel, the edge pixel includes three sub-pixels, and the number of sub-pixels to be adjusted in the set of sub-pixels to be adjusted is three, that is, a first sub-pixel to be adjusted, a second sub-pixel to be adjusted, and a third sub-pixel to be adjusted. In addition, the original brightnesss of the three sub-pixels to be adjusted are 20 nit, 64 nit, and 200 nit, respectively, and the relative transmittances of the three sub-pixels to be adjusted are 10%, 40%, and 80%, respectively, and the preset maximum exhibited brightness is 255 nit. Table 2 is a table of parameters in the compensation process for three sub-pixels to be adjusted in Example 1.

TABLE 2

| | first sub-pixel to be adjusted | second sub-pixel to be adjusted | third sub-pixel to be adjusted |
|---|---|---|---|
| Original brightness | 20 nit | 64 nit | 200 nit |
| relative transmittance | 10% | 40% | 80% |
| Ideal target brightness | 200 nit | 160 nit | 250 nit |
| Final target brightness | 200 nit | 160 nit | 250 nit |

It can be determined in the step S401 that there is no ideal target brightness greater than the preset maximum exhibited brightness, therefore, it can be determined in the step S402 that the final target brightness of the actual light-emitting region of each sub-pixel to be adjusted is equal to the ideal target brightness of the actual light-emitting region of the sub-pixel to be adjusted.

At the step S5, the brightness of each sub-pixel to be adjusted is adjusted by the ideal target brightness. In this case, the color shift problem can be effectively solved, and the brightness of each sub-pixel to be adjusted can be compensated so that the original display effect can be maintained to the greatest extent.

EXAMPLE 2

It is assumed that the set of sub-pixels to be adjusted selected in step S1 is obtained from one edge pixel, the edge pixel includes three sub-pixels, and the number of sub-pixels to be adjusted in the set of sub-pixels to be adjusted is three, that is, a first sub-pixel to be adjusted, a second sub-pixel to be adjusted, and a third sub-pixel to be adjusted. In addition, the original brightnesses of the three sub-pixels to be adjusted are 30 nit, 64 nit, and 200 nit, respectively, and the relative transmittances of the three sub-pixels to be adjusted are 10%, 40%, and 100%, respectively, and the preset maximum exhibited brightness is 255 nit. Table 3 is a table of parameters in the compensation process for three sub-pixels to be adjusted in Example 2.

TABLE 3

| | first sub-pixel to be adjusted | second sub-pixel to be adjusted | third sub-pixel to be adjusted |
|---|---|---|---|
| original brightness | 30 nit | 64 nit | 200 nit |
| relative transmittance | 10% | 40% | 90% |
| Ideal target brightness | 300 nit | 160 nit | 222.2 nit |
| final target brightness (the embodiment shown in FIG. 3) | 255 nit | 160 nit | 222.2 nit |
| brightness adjustment ratio (the embodiment shown in FIG. 4) | 85% | 85% | 85% |
| final target brightness (the embodiment shown in FIG. 4) | 255 nit | 136 nit | 188.7 nit |

It can be determined in the step S401 that there is an ideal target brightness greater than the preset maximum exhibited brightness (300 nit>255 nit).

In a case where the technical solution of the embodiment shown in FIG. 3 is adopted, the final target brightness of the actual light-emitting region of the first sub-pixel to be adjusted is determined to be 255 nit in the step S403*a*, the final target brightnesses of the light-emitting regions of the second sub-pixel to be adjusted and the third sub-pixel to be adjusted maintain the ideal target brightnesses, that is, 160 nit and 222.2 nit, respectively.

When the technical solution of the embodiment shown in FIG. 4 is adopted, it is determined in the step S403*b* that the first sub-pixel to be adjusted is the reference sub-pixel, it is determined in the step S404*b* that the final target brightness of the actual light-emitting region of the first sub-pixel to be adjusted is 255 nit, it is calculated in the step S405*b* that the brightness adjustment ratio is 255/300=85%, and it is calculated in the step S406*b* that the final target brightnesses of the second sub-pixel to be adjusted and the third sub-pixel to be adjusted are 136 nit and 188.7 nit respectively. It should be noted that, since the relative transmittance of the third sub-pixel to be adjusted is larger, after the brightness adjustment operation in a same proportion of the step S406*b*, the calculated final target brightness is less than the original brightness (188.7 nit<200 nit). Although the brightness of the display region of the third pixel to be adjusted is lowered, the color shift problem of the edge pixels can be effectively avoided.

It should be noted that the color shift may be improved to some extent by using the technical solution of the embodiment shown in FIG. 3, and the overall brightness of the edge pixels may be made closer to the original brightness; the technical solution of the embodiment shown in FIG. 4 can completely eliminate the color shift problem, and the overall brightness of the edge pixels will still be relatively low.

It should be noted that the case where the sub-pixels in the set of sub-pixels to be adjusted are from one edge pixel is only exemplary, and it does not limit the technical solution of the present disclosure.

In the present disclosure, the sub-pixels in the set of sub-pixels to be adjusted may also be from multiple adjacent edge pixels, and in this case, the multiple adjacent edge pixels may be simultaneously subjected to brightness compensation. In addition, once it is determined in the step S401 that there is an ideal target brightness greater than the preset maximum exhibited brightness, the process proceeds to step S403*a* (the embodiment shown in FIG. 3) or step S403*b* to step S406*b* (the embodiment shown in FIG. 4) to adjust the ideal target brightness, then the smoothness of changes of the final exhibited brightnesses of the adjacent edge pixels can be guaranteed to ensure the display effect.

Certainly, the sub-pixels in the set of sub-pixels to be adjusted may also be from multiple edge pixels in a preset area, for example, all edge pixels located in the R corner area of the display panel, in this case, the smoothness of changes of the final exhibited brightnesses of the edge pixels in the R corner area after compensating can be guaranteed.

The case where the sub-pixels in the set of sub-pixels to be adjusted are from one edge pixel or multiple edge pixels are all fall within the protection scope of the present disclosure.

The display method of the singular-shaped display panel provided by the above embodiments of the present disclosure can adjust the brightnesses of the edge pixels in the singular-shaped display area, and can effectively improve or even eliminate the color shift problem of the edge pixels.

Figure 5:
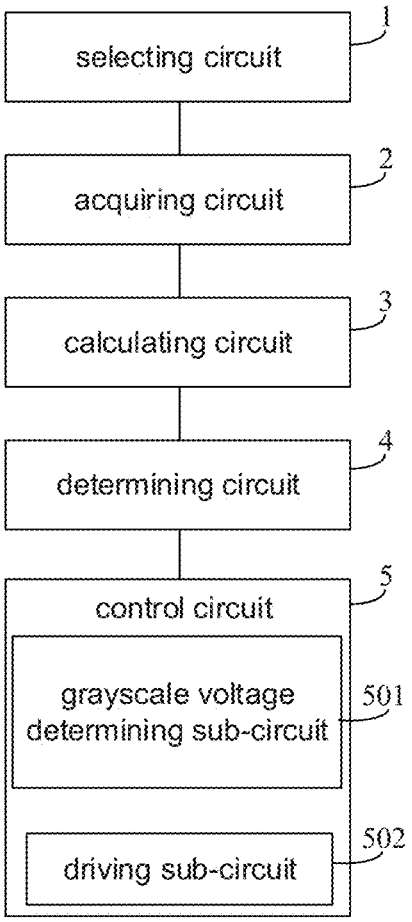
FIG. 5 is a structural block diagram of an edge pixel display system according to another embodiment of the present disclosure.

FIG. 5 is a structural block diagram of an edge pixel display system according to another embodiment of the present disclosure. As shown in FIG. 5, the edge pixel display system can be used to implement the display method of the singular-shaped display panel in the embodiments shown in FIG. 3 and FIG. 4. The edge display system includes a selecting circuit 1, an acquiring circuit 2, a calculating circuit 3, a determining circuit 4, and a control circuit 5.

The selecting circuit 1 is configured to select all sub-pixels in an integer number of edge pixels to form a set of sub-pixels to be adjusted, and each sub-pixel in the set of sub-pixels to be adjusted is regarded as one sub-pixel to be adjusted.

In some implementations, the selecting circuit 1 is specifically configured to select all sub-pixels in one edge pixel to form the set of sub-pixels to be adjusted; or select all sub-pixels in multiple adjacent edge pixels to form the set of sub-pixels to be adjusted; alternatively, select all sub-pixels in all edge pixels on the display panel to form the set of sub-pixels to be adjusted.

The acquiring circuit 2 is configured to acquire an original brightness of a light-transmissive region of each sub-pixel to be adjusted in the set of sub-pixels to be adjusted.

The calculating circuit 3 is configured to calculate an ideal target brightness of an actual light-emitting region of each sub-pixel to be adjusted, and the ideal target brightness of the actual light-emitting region of the sub-pixel to be adjusted is equal to a ratio of the original brightness of the light-transmissive region of the sub-pixel to be adjusted to a relative transmittance of the sub-pixel to be adjusted, wherein the relative transmittance of the sub-pixel to be adjusted is equal to the ratio of an area of the actual light-emitting region to an area of the light-transmissive region of the sub-pixel to be adjusted.

The determining circuit 4 is configured to determine, according to the ideal target brightness of the actual light-emitting region of each of the sub-pixels to be adjusted, a final target brightness of the actual light-emitting region of each of the sub-pixels to be adjusted, wherein the final target brightness is less than or equal to a preset maximum exhibited brightness.

The control circuit 5 is configured to control each of the sub-pixels to be adjusted to display according to the final target brightness of the actual light-emitting region of each of the sub-pixels to be adjusted.

It should be noted that the selecting circuit 1 in this embodiment can be used to implement the step S1 in the foregoing embodiments shown in FIG. 3 and FIG. 4, and the acquiring circuit 2 can be used to implement the step S2 in the foregoing embodiments shown in FIG. 3 and FIG. 4, the calculating circuit 3 can be used to implement the step S3 in the embodiments shown in FIG. 3 and FIG. 4, the determining circuit 4 can be used to implement the step S4 in the embodiments shown in FIG. 3 and FIG. 4, the control circuit 5 can be used to implement the step S5 in the embodiments shown in FIG. 3 and FIG. 4. For the specific operation process of each of the circuits, the corresponding content in the foregoing embodiment shown in FIG. 3 may be referred to, and details are not described herein again.

Figure 6:
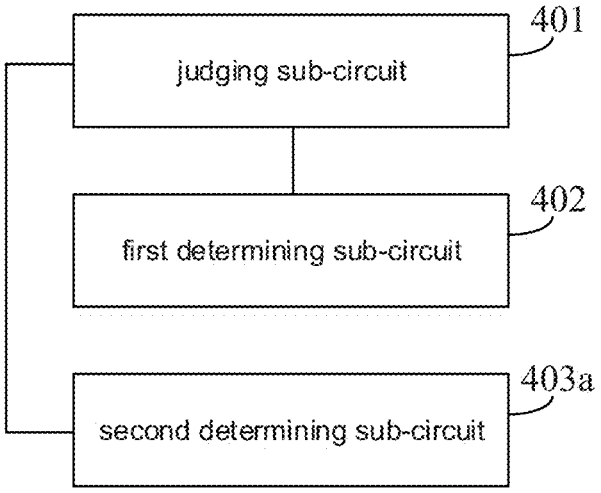
FIG. 6 is a block diagram showing a specific structure of the determining circuit in FIG. 5.

FIG. 6 is a block diagram showing a specific structure of the determining circuit in FIG. 5. As shown in FIG. 6, optionally, the determining circuit 4 includes a judging sub-circuit 401, a first judging sub-circuit 402, and a second judging sub-circuit 403*a*.

The judging sub-circuit 401 is configured to judge whether there is an ideal target brightness greater than a preset maximum exhibited brightness.

The first judging sub-circuit 402 is configured to determine, in a case where the judging sub-circuit determines that there is an ideal target brightness greater than the preset maximum exhibited brightness, the final target brightness of the actual light-emitting region of each sub-pixel to be adjusted to be equal to the ideal target brightness of the actual light-emitting region of the sub-pixel to be adjusted.

The second judging sub-circuit 403*a* is configured to determine, in a case where the judging circuit 401 judges that there is an ideal target brightness greater than the preset maximum exhibited brightness, the final target brightness of the actual light-emitting region of the sub-pixel to be adjusted whose ideal target brightness is greater than the preset maximum exhibited brightness to be equal to the preset maximum exhibited brightness, and determine the final target brightness of the actual light-emitting region of the sub-pixel to be adjusted whose ideal target brightness is less than or equal to the preset maximum exhibited brightness to be equal to the ideal target brightness of the actual light-emitting region of the sub-pixel to be adjusted.

Figure 7:
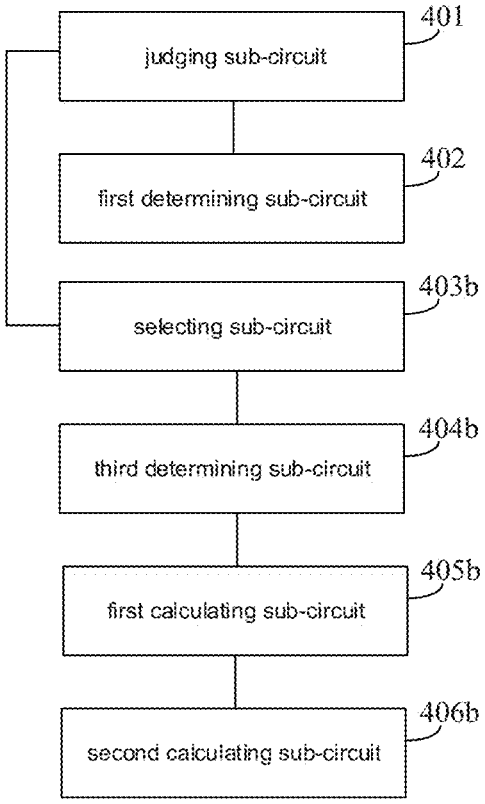
FIG. 7 is another block diagram of the specific structure of the determining circuit in FIG. 5.

The determining circuit shown in FIG. 6 can perform the step S4 in the embodiment shown in FIG. 3, wherein the judging sub-circuit 401 can perform the step S401 in the embodiment shown in FIG. 3, the first judging sub-circuit 402 can perform the step S402 in the embodiment shown in FIG. 3, and the second judging sub-circuit 403*a* can perform the step S403*a* in the embodiment shown in FIG. 3, the specific description of each of the sub-circuits can be referred to the content in the embodiment FIG. 7 is another block diagram of the specific structure of the determining circuit in FIG. 5. The determining circuit 4 includes a judging sub-circuit 401, a first judging sub-circuit 402, a selecting sub-circuit 403*b*, a third judging sub-circuit 404*b*, and a first calculating sub-circuit 405*b* and a second calculating sub-circuit 406*b*.

The judging sub-circuit 401 is configured to judge whether there is an ideal target brightness greater than a preset maximum exhibited brightness.

The first judging sub-circuit 402 is configured to determine, in a case where the judging sub-circuit 401 judges that there is no ideal target brightness greater than the preset maximum exhibited brightness, the final target brightness of the actual light-emitting region of each sub-pixel to be adjusted to be equal to the ideal target brightness of the actual light-emitting region of a reference sub-pixel.

The selecting sub-circuit 403*b* is configured to select, in a case where the judging sub-circuit 401 judges that there is an ideal target brightness greater than the preset maximum exhibited brightness, the sub-pixel to be adjusted, whose actual light-emitting region has the largest ideal target brightness, as the reference sub-pixel.

The third judging sub-circuit 404*b* is configured to determine the final target brightness of the actual light-emitting region of the reference sub-pixel to be equal to the preset maximum exhibited brightness.

The first calculating sub-circuit 405*b* is configured to calculate a brightness adjustment ratio that is equal to a ratio of the final target brightness of the actual light-emitting region of the reference sub-pixel to the ideal target brightness of the actual light-emitting region of the reference sub-pixel.

The second calculating sub-circuit 406*b* is configured to calculate the final target brightness of the actual light-emitting region of each sub-pixel to be adjusted, and the final target brightness of the actual light-emitting region of the sub-pixel to be adjusted is equal to a product of the ideal target brightness of the actual light-emitting region of the sub-pixel to be adjusted and the brightness adjustment ratio.

The determining circuit shown in FIG. 7 can perform the step S4 in the embodiment shown in FIG. 4, wherein the judging sub-circuit 401 can perform the step 5401 in the embodiment shown in FIG. 4, the first judging sub-circuit 402 can perform the step S402 in the embodiment shown in FIG. 4, the selecting sub-circuit 403*b* can perform the step S403*b* in the embodiment shown in FIG. 4, the third judging sub-circuit 404*b* can perform the step S404*b* in the embodiment shown in FIG. 4, the first calculating sub-circuit 405*b* may perform the step S405*b* in the embodiment shown in FIG. 4, and the second calculating sub-circuit 406*b* may perform the step S406*b* in the embodiment shown in FIG. 6. For a detailed description of each of the above sub-circuits, reference may be made to the corresponding content in the embodiment shown in FIG. 4 above.

In some implementations, the control circuit 5 includes a grayscale voltage judging sub-circuit 501 and a driving sub-circuit 502.

The grayscale voltage judging sub-circuit 501 is configured to determine a grayscale voltage corresponding to each of the final target brightnesses. Further, in some implementations, the grayscale voltage judging sub-circuit 501 is specifically configured to determine the grayscale voltage corresponding to each of the final target brightnesses according to a preset grayscale-brightness correspondence table.

The driving sub-circuit 502 is configured to supply a corresponding grayscale voltage to each sub-pixel to be adjusted.

It should be noted that, in this embodiment, the grayscale voltage judging sub-circuit 501 can be used to perform the step S501 in the embodiment shown in FIG. 3, and the driving sub-circuit 502 can be used to perform the step S502 in the embodiment shown in FIG. 3. For a detailed description of each of the above sub-circuits, reference may be made to the corresponding content in the embodiment shown in FIG. 3 above.

The edge pixel display system in this embodiment may be implemented by hardware, software, or a combination of both the hardware and the software. For example, the circuit or the sub-circuit described in the embodiments of the present disclosure may be implemented by software, may be implemented by hardware, or may be implemented by a combination of the software and the hardware. The described software or hardware can be provided in the processor. For example, when the edge pixel display system of the present embodiment is implemented by the software, it can be stored in a memory and read by the processor from the memory to perform operations to implement the functions of the edge pixel display system described above.

The edge pixel display system provided in the embodiment of the present disclosure can adjust the brightnesses of the edge pixels in the singular-shaped display area, and can effectively improve or even eliminate the color shift problem of the edge pixels.

Another embodiment of the present disclosure provides a storage device in which a program is stored, and when the program is executed, the display method of the singular-shaped display panel in the embodiment shown in FIG. 3 or the embodiment shown in FIG. 4 is executed.

The above program includes computer program code, and the computer program code may be in the form of source code, object code, executable file or a certain intermediate form. The storage device may include any entity or device capable of carrying the computer program code, such as a recording medium, a USB flash drive, a mobile hard disk, a magnetic disk, an optical disk, a computer memory, a read-only memory (ROM), and a random access memory (RAM) and so on.

Still another embodiment of the present disclosure provides a display device including the edge pixel display system described above.

As an alternative, the edge pixel display system can be integrated in the display device in the form of a chip and is configured to compensate for the edge pixels at the R corner during displaying.

It should be understood that the above implementations are merely exemplary embodiments for the purpose of illustrating the principles of the present disclosure, however, the present disclosure is not limited thereto. It will be apparent to those skilled in the art that various changes and modifications can be made without departing from the spirit and essence of the present disclosure, which are also to be regarded as falling within the scope of the present disclosure.

What is claimed is:

1. A display method of a singular-shaped display panel, the singular-shaped display panel comprises multiple edge pixels each of which comprises a plurality of sub-pixels, each of the sub-pixels comprises a light-transmissive region and an non-light-transmissive area, wherein a portion of the light-transmissive region of at least one of the sub-pixels of each edge pixel is blocked by a light-blocking pattern, and another portion of the light-transmissive region of the at least one of the sub-pixels of each edge pixel not being blocked is an actual light-emitting region, the display method of the singular-shaped display panel comprises:

selecting all of the sub-pixels in at least one edge pixel to form a set of sub-pixels to be adjusted, and each sub-pixel in the set of sub-pixels to be adjusted is regarded as one sub-pixel to be adjusted;

acquiring an original brightness of the light-transmissive region of each of the sub-pixels to be adjusted in the set of sub-pixels to be adjusted;

calculating an ideal target brightness of the actual light-emitting region of each of the sub-pixels to be adjusted, the ideal target brightness of the actual light-emitting region of the sub-pixel to be adjusted is equal to a ratio of the original brightness of the light-transmissive region of the sub-pixel to be adjusted to a relative transmittance of the sub-pixel to be adjusted, wherein the relative transmittance of the sub-pixel to be adjusted is equal to the ratio of an area of the actual light-emitting region to an area of the light-transmissive region of the sub-pixel to be adjusted;

determining, according to the ideal target brightness of the actual light-emitting region of each of the sub-pixels to be adjusted, a final target brightness of the actual light-emitting region of each of the sub-pixels to be adjusted, wherein the final target brightness is less than or equal to a preset maximum exhibited brightness; and controlling each of the sub-pixels to be adjusted to display according to the final target brightness of the actual light-emitting region of each of the sub-pixels to be adjusted.

2. The display method of the singular-shaped display panel according to claim 1, wherein determining, according to the ideal target brightness of the actual light-emitting region of each of the sub-pixels to be adjusted, a final target brightness of the actual light-emitting region of each of the sub-pixels to be adjusted comprises:

judging whether there is an ideal target brightness greater than the preset maximum exhibited brightness;

determining, in response to that there is no ideal target brightness greater than the preset maximum exhibited brightness, the final target brightness of the actual light-emitting region of each of the sub-pixels to be adjusted to be equal to the ideal target brightness of the actual light-emitting region of the sub-pixel to be adjusted.

3. The display method of the singular-shaped display panel according to claim 2, wherein in response to that there is an ideal target brightness greater than the preset maximum exhibited brightness, determining the final target brightness of the actual light-emitting region of the sub-pixel to be adjusted whose ideal target brightness is greater than the preset maximum exhibited brightness to be equal to the preset maximum exhibited brightness, and determining the final target brightness of the actual light-emitting region of the sub-pixel to be adjusted whose ideal target brightness is less than or equal to the preset maximum exhibited brightness to be equal to the ideal target brightness of the actual light-emitting region of the sub-pixel to be adjusted.

4. The display method of the singular-shaped display panel according to claim 2, wherein in response to that there is an ideal target brightness greater than the preset maximum exhibited brightness, selecting the sub-pixel to be adjusted, whose actual light-emitting region has the largest ideal target brightness, as a reference sub-pixel;

determining the final target brightness of the actual light-emitting region of the reference sub-pixel to be equal to the preset maximum exhibited brightness;

calculating a brightness adjustment ratio, the brightness adjustment ratio being equal to a ratio of the final target brightness of the actual light-emitting region of the reference sub-pixel to the ideal target brightness of the actual light-emitting region of the reference sub-pixel;

calculating the final target brightness of the actual light-emitting region of each of the sub-pixels to be adjusted, and the final target brightness of the actual light-emitting region of the sub-pixel to be adjusted is equal to a product of the ideal target brightness of the actual light-emitting region of the sub-pixel to be adjusted and the brightness adjustment ratio.

5. The display method of the singular-shaped display panel according to claim 1, wherein controlling each of the sub-pixels to be adjusted to display according to the final target brightness of the actual light-emitting region of each of the sub-pixels to be adjusted comprises:

determining grayscale voltages corresponding to final target brightnesses of the sub-pixels to be adjusted;

supplying the grayscale voltages to the sub-pixels to be adjusted respectively.

6. The display method of the singular-shaped display panel according to claim 5, wherein determining the grayscale voltages corresponding to the final target brightnesses of the sub-pixels to be adjusted comprises:

determining the grayscale voltages corresponding to the final target brightnesses of the sub-pixels to be adjusted according to a grayscale-brightness correspondence table.

7. The display method of the singular-shaped display panel according to claim 6, wherein selecting all of the sub-pixels in at least one edge pixel to form a set of sub-pixels to be adjusted comprises:

selecting all of the sub-pixels in one of the edge pixels to form the set of sub-pixels to be adjusted.

8. The display method of the singular-shaped display panel according to claim 6, wherein selecting all of the sub-pixels in at least one edge pixel to form a set of sub-pixels to be adjusted comprises:

selecting all of the sub-pixels in multiple adjacent edge pixels to form the set of sub-pixels to be adjusted.

9. The display method of the singular-shaped display panel according to claim 6, wherein selecting all of the sub-pixels in at least one edge pixel to form a set of sub-pixels to be adjusted comprises:

selecting all of the sub-pixels in all edge pixels on the display panel to form the set of sub-pixels to be adjusted.

10. A display system of a singular-shaped display panel, the singular-shaped display panel comprises multiple edge pixels each of which comprises a plurality of sub-pixels, each of the sub-pixels comprises a light-transmissive region and an non-light-transmissive region, wherein a portion of the light-transmissive region of at least one of the sub-pixels of each edge pixel is blocked by a light-blocking pattern, and another portion of the light-transmissive region of the at least one of the sub-pixels of each edge pixel not being blocked is an actual light-emitting region, the display system comprises:

a selecting circuit, configured to select all of the sub-pixels in at least one edge pixel to form a set of sub-pixels to be adjusted, and each of the sub-pixels in the set of sub-pixels to be adjusted is regarded as a sub-pixel to be adjusted;

an acquiring circuit, configured to acquire an original brightness of the light-transmissive region of each of the sub-pixels to be adjusted in the set of sub-pixels to be adjusted;

a calculating circuit, configured to calculate an ideal target brightness of the actual light-emitting region of each of the sub-pixels to be adjusted, the ideal target brightness of the actual light-emitting region of the sub-pixel to be adjusted is equal to a ratio of the original brightness of the light-transmissive region of the sub-pixel to be adjusted to a relative transmittance of the sub-pixel to be adjusted, wherein the relative transmittance of the sub-pixel to be adjusted is equal to a ratio of an area of the actual light-emitting region of the sub-pixel to be adjusted to an area of the light-transmissive region of the sub-pixel to be adjusted;

a determining circuit, configured to determine, according to the ideal target brightness of the actual light-emitting region of each of the sub-pixels to be adjusted, a final target brightness of the actual light-emitting region of each of the sub-pixels to be adjusted, wherein the final target brightness is less than or equal to a preset maximum exhibited brightness; and a control circuit, configured to control each of the sub-pixels to be adjusted to display according to the final target brightness of the actual light-emitting region of each of the sub-pixels to be adjusted.

11. The display system according to claim 10, wherein the determining circuit comprises:

a judging sub-circuit, configured to judge whether there is an ideal target brightness greater than the preset maximum exhibited brightness;

a first judging sub-circuit, configured to determine, in response to that there is no ideal target brightness greater than the preset maximum exhibited brightness, the final target brightness of the actual light-emitting region of each of the sub-pixels to be adjusted to be equal to the ideal target brightness of the actual light-emitting region of the sub-pixel to be adjusted.

12. The display system according to claim 11, wherein the determining circuit further comprises:

a second judging sub-circuit, configured to determine, in response to that there is an ideal target brightness greater than the preset maximum exhibited brightness, the final target brightness of the actual light-emitting region of the sub-pixel to be adjusted whose ideal target brightness is greater than the preset maximum exhibited brightness to be equal to the preset maximum exhibited brightness, and the final target brightness of the actual light-emitting region of the sub-pixel to be adjusted whose ideal target brightness is less than or equal to the preset maximum exhibited brightness to be equal to the ideal target brightness of the actual light-emitting region of the sub-pixel to be adjusted.

13. The display system according to claim 11, wherein the determining circuit further comprises:

a selecting sub-circuit, configured to select, in response to that there is an ideal target brightness greater than the preset maximum exhibited brightness, the sub-pixel to be adjusted, whose actual light-emitting region has the largest ideal target brightness, as a reference sub-pixel;

a third judging sub-circuit, configured to determine the final target brightness of the actual light-emitting region of the reference sub-pixel to be equal to the preset maximum exhibited brightness:

a first calculating sub-circuit, configured to calculate a brightness adjustment ratio, the brightness adjustment ratio being equal to a ratio of the final target brightness of the actual light-emitting region of the reference sub-pixel to the ideal target brightness of the actual light-emitting region of the reference sub-pixel;

a second calculating sub-circuit, configured to calculate the final target brightness of the actual light-emitting region of each of the sub-pixels to be adjusted, and the final target brightness of the actual light-emitting region of the sub-pixel to be adjusted is equal to a product of the ideal target brightness of the actual light-emitting region of the sub-pixel to be adjusted and the brightness adjustment ratio.

14. The display system according to claim 10, wherein the control circuit comprises:

a grayscale voltage judging sub-circuit, configured to determine grayscale voltages respectively corresponding to the final target brightnesses of the sub-pixels to be adjusted;

a driving sub-circuit, configured to supply the grayscale voltages to the sub-pixels to be adjusted respectively, wherein the grayscale voltage judging sub-circuit determines the grayscale voltages corresponding to the final target brightnesses of the sub-pixels to be adjusted according to a grayscale-brightness correspondence table.

15. The display system according to claim 10, wherein the selecting circuit is configured to select all of the sub-pixels in one of the edge pixels to form the set of sub-pixels to be adjusted.

16. The display system according to claim 10, wherein the selecting circuit is configured to select all of the sub-pixels in multiple adjacent edge pixels to form the set of sub-pixels to be adjusted.

17. The display system of claim 10, wherein the selecting circuit is configured to select all of the sub-pixels in all edge pixels on the display panel to form the set of sub-pixels to be adjusted.

18. A storage device, wherein a program is stored in the storage device, and the display method of the singular-shaped display panel according to claim 1 is performed when the program is executed.

19. A display device, comprising the display system according to claim 10.

* * * * *